US006275448B1

(12) United States Patent
Kittower et al.

(10) Patent No.: US 6,275,448 B1
(45) Date of Patent: Aug. 14, 2001

(54) PRESSURE-COMPENSATED ACCELERATION-INSENSITIVE HYDROPHONE

(75) Inventors: Elmore Kittower, Tarzana; James W. Pell, Jr., Canyon Country, both of CA (US)

(73) Assignee: L3 Communication, Sylmar, CA (US)

( * ) Notice: Subject to any disclaimer, the term of this patent is extended or adjusted under 35 U.S.C. 154(b) by 0 days.

(21) Appl. No.: 05/860,012

(22) Filed: Dec. 12, 1977

(51) Int. Cl.[7] ..... H04R 17/00

(52) U.S. Cl. ..... 367/155; 367/158; 367/166; 367/167; 367/171; 367/172

(58) Field of Search ..... 340/8 R, 8 PC, 340/81 F, 9, 10, 11, 12, 13, 14; 367/155, 157, 158, 159, 165, 166, 167, 171, 172

(56) References Cited

U.S. PATENT DOCUMENTS 1,101,830 * 6/1914 Berger ..... 340/13 R
2,961,637 * 11/1960 Camp ..... 340/10
3,025,359 * 3/1962 Schilling et al. ..... 340/10 R
3,281,770 * 10/1966 Sims ..... 340/10 X
3,311,873 * 3/1967 Schloss ..... 340/10
4,017,824 * 4/1977 Fife et al. ..... 340/8 R

* cited by examiner

*Primary Examiner*—Harold J. Tudor
(74) *Attorney, Agent, or Firm*—Roberts & Mercanti, LLP

(57) ABSTRACT

A generally cylindrical hydrophone configuration provides compensation for longitudinal accelerations by placing four identical solid piezoelectric transducer elements along its axis with each transducer element being bonded to a head member, two of which are located generally centrally of the cylindrical housing and fastened thereto and two of which are located near the outside edges of the housing and having slight clearance therewith. Flexible polyurethane boots are clamped to the ends of the housing. The volumes between the centrally disposed and outer transducer head members and between the outer head members and the boots are filled with methyl silicon fluid. Each head member is electrically connected to one side of the electrical output, and the junction between the transducer members is connected to the opposite side, both sides being wired to an electrical contact plate located between the two centrally disposed transducer head members, this volume being filled with electrical potting material. The clearance between the outside transducer heads and the side wall of the housing is controlled to permit long-term pressure equalization without significantly affecting frequency response down to 10 Hz or somewhat lower.

8 Claims, 1 Drawing Sheet

FIG. 1
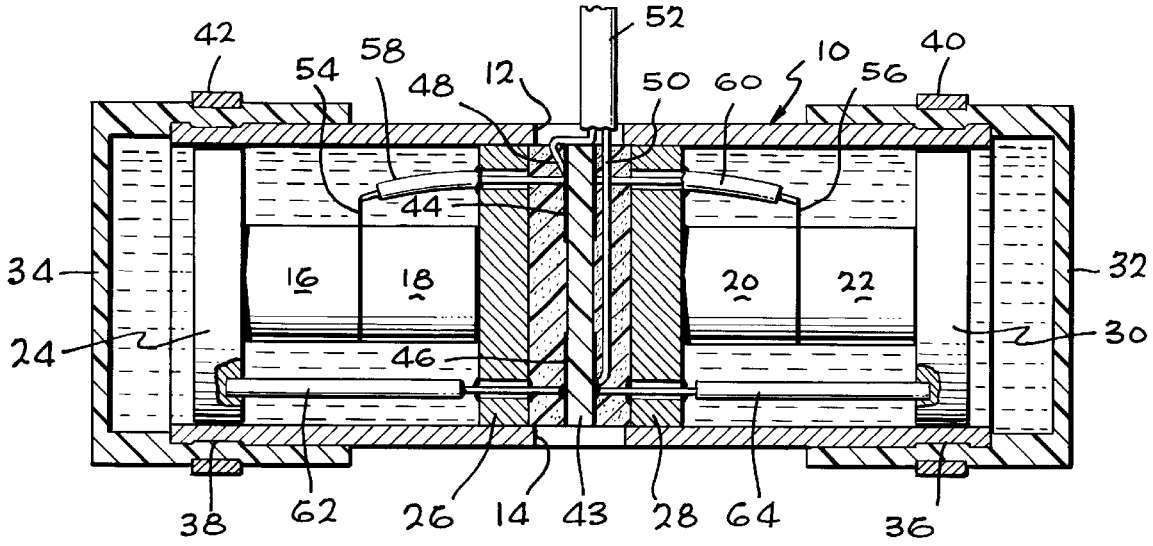
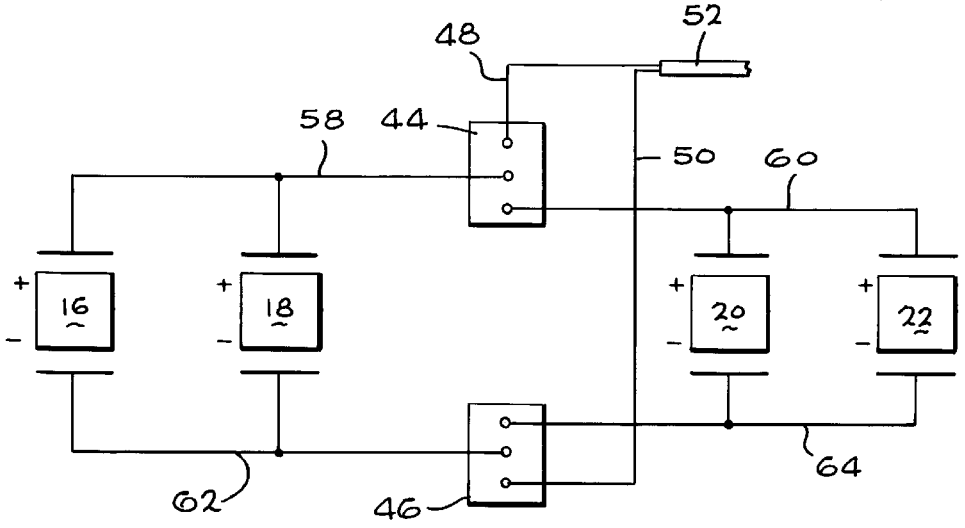
FIG. 2

PRESSURE-COMPENSATED ACCELERATION-INSENSITIVE HYDROPHONE

BACKGROUND OF THE INVENTION

Towed arrays have been used for some time as listening devices for detecting the presence of underwater sound sources. Such arrays consist of a series of interconnected hydrophones with the requisite electronics encased in a flexible tubular jacket. These arrays may be manufactured in sections of any desired length, such as 50 or 100 feet, which may be connected end to end to produce a much longer array. Such arrays are then towed behind a ship, often at a substantial distance and at moderate speeds to minimize noise related to turbulence from the ship's wake and from velocity effects. So long as the array is being pulled through the water certain longitudinal acceleration and deceleration forces on the array are inevitable, and these forces tend to result in the production of spurious signals from the hydrophones.

The problem of acceleration-induced spurious signals has been dealt with in earlier hydrophone designs by placing pairs of hydrophones physically back to back to produce a structure in which longitudinal accelerations tend to shorten one element while elongating the other, thus canceling or substantially canceling the spurious acceleration-induced signals. Frequently such hydrophones have used hollow cylindrical transducer elements of piezoelectric material having both inside and outside surfaces exposed to oil and having an orifice or port to permit oil to flow across the wall for pressure compensation. The pressure-equalizing port has been found to introduce undesirable phase shifts into the output—at some frequencies, at least. Also, the hollow ceramic elements tend to be fragile and subject to damage from rough handling on deck. Flexing of the side walls of the acoustic elements has also been shown to introduce some spurious signals.

In an effort to overcome some of the above problems, one of the applicants herein and another devised the hydrophone shown and describe in U.S. Pat. No. 4,017,824 (common assignee). The patented design employs solid ceramic pizeoelectric transducer elements affixed back to back against a central bulkhead. The outside end surfaces of the elements were bonded to end caps physically sealed to the inside of the housing with O-ring seals. The volume inside the end caps not occupied by the elements contains air so the hydrophone is not pressure-compensated and must resist the ambient pressure. While this hydrophone is quite operative, it has disadvantages in that the lack of pressure compensation results in an excessive stress in the piezoelectric element at great depths. It is also believed that the non-pressure-compensated design also suffers from a disadvantage in that, on a long term basis, the piezoelectric characteristics of the elements are subject to change where they are wholly or partially unloaded on the side walls. Another problem area is in the difficulty of assembly. The hydrophones described in the patent referred to above (both versions) are also somewhat difficult to assemble.

DESCRIPTION OF THE DRAWINGS

FIG. 1 is a sectional drawing of a hydrophone incorporating our invention; and FIG. 2 is a schematic diagram of the electrical circuit incorporated into the hydrophone of FIG. 1.

DESCRIPTION OF THE PREFERRED EMBODIMENT

The hydrophone shown in FIG. 1 includes a cylindrical housing member 10 having openings at each end and smaller openings 12 and 14 centered along its side wall. Alternatively, housing 10 may be fabricated of two short cylindrical members with the openings formed by notches positioned at the center and fastened together with a suitable bonding agent such as epoxy cement. Carried within the housing 10 are a plurality of solid ceramic piezoelectric transducer members 16, 18, 20 and 22 of material such as lead zirconate titanate, which may be identical. The transducer members are bonded to and make electrical contact with head members 24, 26, 28 and 30, respectively, by means of a conductive adhesive. These head members are typically of aluminum. Head members 26 and 28 are an interference fit with the inner wall of housing 10, and head members 24 and 30 are dimensioned to a close tolerance to provide a precise clearance with the side wall which will permit a limited flow of fluid across these members. Closing each end of the cylinder 10 are cup-shaped boots 32, 34 of polyurethane plastic material. Shallow grooves 36 and 38 are formed in the outside wall of housing 10, and the boots 32 and 34 are held in place and compressed into these grooves by means of compression rings 40 and 42, respectively. Centered along the axis of the cylindrical housing is a contact plate 43 having electrical contacts 44 and 46 soldered or otherwise electrically connected to conducting wires 48 and 50, respectively. Wire 48 is connected to the conducting shield, and wire 50 is a continuation of the center lead of a coaxial conductor pair 52 which carries the hydrophone signal to an external utilization source not forming part of the present invention. It is apparent that opening 12 is used to permit entry of conductor 52. Opening 14 is used to permit the volume between head members 26 and 28 to be filled with epoxy potting compound which also serves the function of fastening head members 26 and 28 to the inner wall of housing 10. The volumes between heads 24 and 26 and between heads 28 and 30 are filled with a suitable liquid having an acoustic impedance similar to that of the surrounding medium (salt water) such as a methyl silicone fluid, as are the volumes between boot 32 and head 30 and between boot 34 and head member 24. The clearances between heads 24 and 30 and the inside surface of housing 10 are chosen to permit comparatively long-term hydrostatic pressures to be transferred across the head members while minimizing the loss of pressure amplification effect at lower frequencies. Good frequency response is maintained down to 10 Hz or somewhat below. A discussion of the factors involved in calculating the effective area of this clearance appears in NRL Report 7738, "A Hydrophone for Measuring the Acoustic Ambient Noise in the Ocean at Low Frequency-USRD Type H62", by I. D. Groves, Jr., Apr. 15, 1974, Standards Branch, Underwater Sound Ref. Div.

As described above, each of the piezoelectric transducer members 16, 18, 20 and 22 makes electrical contact with its adjacent head member. An electrical contact 54 communicates with the adjacent surfaces of transducer members 16 and 18, and a similar electrical contact 56 communicates with the adjacent surfaces of transducer members 20 and 22. A wire 58 is soldered to contact 44 and is fed through a channel in head member 26, but insulated therefrom and connected to contact 54. A similar wire 60 is soldered to the opposite side of contact 44, fed through a channel in head member 28, but insulated therefrom, and bonded to contact 56. A wire 62 is connected to contact 46, fed through a second channel in head 26, and bonded to head 24, making electrical contact with both of head members 24 and 26. Similarly, a wire 64 is fed through a second channel in head 28 and bonded to head 30, making electrical contact with both of head members 28 and 30.

Referring now to FIG. 2, electrical signals will be generated by the transducer members 16, 18, 20 and 22 which are all effectively connected in parallel with the positive (+) side of the circuit connected through wires 58 and 60 to contact 44 and thence to wire 48. The negative (–) side of the circuit is shown connected from the opposite sides of the transducer members through wires 62 and 64 to contact 46 and thence to wire 50. Referring again to FIG. 1, it will be recognized that the head members 24, 26, 28 and 30 are on the negative side of the circuit and the contacts 54 and 56 are on the positive side.

When the hydrophone is exposed to acoustic signals, varying pressures are communicated to the polyurethane boots 32 and 34 which are essentially acoustically transparent and which transmit these varying pressures to the methyl silicone fluid on the inside of the boots and, hence, to the faces of head members 24 and 30 where they act to vary the compression acting on the transducer members, thus causing said members to generate electrical signals corresponding to the acoustic signals applied.

The described hydrophone avoids many of the problems referred to above. Since it is pressure balanced, it does not have to be stressed to withstand deep ocean pressures across its side walls, and it has a good area transformation ratio; hence, good sensitivity. It utilizes solid piezoelectric transducer elements rather than hollow ones, so it is not particularly fragile and can withstand normal deck handling. Since it does not utilize a conventional pressure-equalizing port, it does not suffer from the frequency response limitations such ports often impose. The clearances around the beads 24 and 30 do provide some pressure equalization, but these clearances are equivalent to a very small orifice and permit good low-frequency response. Since the rate at which pressure equalization takes place is quite slow, there are limitations as to how rapidly our described hydrophone may be raised from substantial ocean depths without danger of damage. The assembly difficulties described above in connection with an earlier design have been largely overcome, and assembly of the hydrophone described herein is quite straightforward. The tolerances between the heads and the side walls need to be carefully controlled, but fabrication of these parts is straightforward, and there are no special problems in assembly. Greater numbers of transducer elements, such as eight (four on each side, wired in parallel to those shown), may be used if desired, at some expense in complexity. The volume of the chamber enclosed by the boots should preferably be made sufficient that, as the face of the boot tends to be driven inwardly by ambient pressure at substantial depths resulting from the compressibility of methyl silicone and the thermal volumetric contraction due to colder temperatures of the surrounding ocean water at great depths, it does not actually reach or touch the face of the adjoining head member.

We claim:

1. A hydrophone for providing electrical output signals in response to sensed acoustic signals comprising a cylindrical housing open at each end, four solid ceramic piezoelectric transducer elements in said housing, a metal transducer head member bonded to one end of each of said transducer elements, said head members, including two members generally centrally located in said housing and firmly fastened thereto forming a central space which is filled and two members positioned near the end openings of said housing having significant clearance therewith, an electrical conductor having two wires, means connecting one of said wires to each of said head members, means connecting the other of said wires to the opposite ends of said transducer elements, an acoustically transparent flexible boot clamped over each end of said housing, and liquid acoustic material filling the spaces between said centrally located and outside head members and between said outside head members and said boots.

2. A hydrophone for providing electrical output signals as set forth in claim 1 wherein said cylindrical housing includes at least one opening generally centrally located along its side wall to provide access to said electrical conductor and an electrical contact plate forming part of said connecting means is located in said housing between said centrally located head members connected to said electrical conductor.

3. A hydrophone for providing electrical output signals as set forth in claim 2 wherein the space between said centrally located head members is filled with electrical potting compound.

4. A hydrophone for providing electrical output signals as set forth in claim 1 wherein said two transducer head members near the end openings of said housing are dimensioned such that said clearance permits long term pressure equalization across said head members but does not cause significant low-frequency cut-off at frequencies around 10 Hz.

5. A hydrophone for providing electrical output signals in response to sensed acoustic signals comprising a hollow cylindrical housing having a small opening approximately centrally located along the side wall thereof, an electrical contact plate having two sets of contacts in said housing adjacent said small opening, first and second transducer head members in said housing, each having first and second passageways therethrough located centrally in said housing on opposite sides of said contact plate, said head members fitting tightly in said housing, third and fourth transducer head members loosely fitted in said housing to provide a small clearance therefrom and located near the ends of said cylindrical housing;

a plurality of solid ceramic piezoelectric transducer members in said housing, one of which is bonded to each of said transducer head members, said transducer members on each side of said first and second transducer head members being bonded together;

an electrical terminal at each junction of said piezoelectric members and means connecting one of said sets of contacts of said contact plate through said first passageways to each of said electrical terminals;

means connecting the other of said contacts of said contact plate to said first and second transducer head members and through said second passageways to said third and fourth transducer head members, an electrical conductor connected through said small opening to each of said sets of contacts for carrying said output signals, flexible boot members closing the ends of said cylindrical housing, and liquid acoustic material in said housing on each side of said third and fourth transducer head members.

6. A hydrophone for providing electrical output signals as set forth in claim 5 wherein the space between said first and second transducer head members is filled with electrical potting compound.

7. A hydrophone for providing electrical output signals as set forth in claim 5 wherein the space between said boot members and said third and fourth transducer head members is of sufficient volume to assure that when said boots are exposed to normal operating pressure they do not deform sufficiently to contact the faces of said third and fourth transducer head members.

8. A hydrophone for providing electrical output signals in response to sensed acoustic signals comprising a hollow cylindrical housing having a small opening approximately centrally located along the side wall thereof, an electrical contact plate having two sets of contacts in said housing adjacent said small opening, first and second transducer head members in said housing, each having first and second passageways therethrough located centrally in said housing on opposite sides of said contact plate, said head members fitting tightly in said housing, third and fourth transducer head members loosely fitted in said housing to provide a small clearance therefrom and located near the ends of said cylindrical housing;

a plurality of solid ceramic piezoelectric transducer members in said housing arranged in two groups on opposite sides of said first and second transducer head members and connected in parallel to said contact plate with said transducer head members connected together to one of said sets of contacts;

an electrical conductor connected through said small opening to each of said sets of contacts for carrying said output signals, flexible boot members closing the ends of said cylindrical housing; and liquid acoustic material in said housing on each side of said third and fourth transducer head members.

* * * * *